US006268556B1

(12) United States Patent
Liao

(10) Patent No.: US 6,268,556 B1
(45) Date of Patent: Jul. 31, 2001

(54) STEPLESS CYMBAL ADJUSTER

(76) Inventor: Tsun-Chi Liao, No. 14, Chun-Kung Rd., Pei-Tun Dist., Taichung City (TW)

( * ) Notice: Subject to any disclaimer, the term of this patent is extended or adjusted under 35 U.S.C. 154(b) by 0 days.

(21) Appl. No.: 09/689,672

(22) Filed: Oct. 13, 2000

(51) Int. Cl.[7] ..... G10D 13/02

(52) U.S. Cl. ..... 84/421; 84/327; 84/422.3; 248/291.1; 248/299.1; 248/187.1

(58) Field of Search ..... 84/421, 327, 422.3; 248/291.1, 187.1, 299.1, 514, 515

(56) References Cited

U.S. PATENT DOCUMENTS 5,756,912 * 5/1998 Liao ..... 84/421
5,836,561 * 11/1998 Liao ..... 248/291.7
6,162,978 * 12/2000 Chang ..... 84/421

FOREIGN PATENT DOCUMENTS

05199922 * 8/1993 (JP) .

* cited by examiner

*Primary Examiner*—Shih-Yung Hsieh
(74) *Attorney, Agent, or Firm*—Bacon & Thomas, PLLC

(57) ABSTRACT

A stepless cymbal adjuster comprises a main body, an adjustment block, a lateral cover, and a plurality of rubbing pieces, wherein the main body is composed of a lateral board; a central tube; a plurality of concave storage rooms, and two pieces of protruding ear adjacent to the storage rooms; the adjustment block is provided with an upwardly extended stud; the lateral cover contains a central through hole, a plurality of storage rooms, and a protruding ear. The protruding ears are penetrated with a pivotally fixing stud to ensure a reliable joint of the main body and the lateral cover when regulating the cymbal's angle.

4 Claims, 7 Drawing Sheets

STEPLESS CYMBAL ADJUSTER

BACKGROUND OF THE INVENTION

This invention relates generally to cymbal stands, more particularly to a stepless cymbal adjuster for adjustment of a cymbal's angle to meet a user's personal conditions and requirements.

As illustrated in an elevational view and an exploded view of a conventional cymbal stand shown in FIGS. 1 and 2, an angular adjuster disposed on the top end of the cymbal stand mainly comprises a first and a second socket, wherein a lateral face of the first socket is recessed to have a ratchet ring circularly disposed therein; a link rod is arranged at a lateral face and an external thread segment is formed on a top section of the first socket; a positioning component and two cotton washers for clamping a cymbal are sequentially disposed on the link rod from the bottom to the top; the thread segment is provided with a tapped revolving nut; a plurality of ratchet pieces is protrusively formed in a lateral inner face of the second socket for engaging the ratchet ring of the first socket with the ratchet pieces of the second socket; a locking member is used to penetrate those two sockets axially; and a compressible spring is interpolated between those two sockets.

By taking advantage of those two sockets, position and angle of a cymbal on a cymbal stand can be adjusted to meet a user's personal requirements. However, as a stepless adjustment can not be achieved in adjusting mesh between the ratchet pieces and the ratchet ring, deviation is inevitably resulted to wear the angular adjuster and deteriorate its operativity.

SUMMARY OF THE INVENTION

The primary object of this invention is to provide a stepless cymbal adjuster having a plurality of rubbing pieces embedded in storage rooms enclosed by a main body, an adjustment block, and a lateral cover for adjusting cymbal angle to meet a user's personal conditions or requirements.

Another object of this invention is to provide a stepless cymbal adjuster having a pivotally fixing stud penetrated through protruding ears for securing a lateral cover to a main body.

In order to realize abovesaid objects, the stepless cymbal adjuster of this invention comprises:

- a main body composed of: a lateral board; a central tube protrusively located on the lateral board; a plurality of storage rooms annularly aligned surrounding the central tube; and two pieces of protruding ear located adjacently to the storage rooms;
- an adjustment block containing: a concave storage room formed in each of two lateral faces respectively; a centered through hole; and an upwardly extended stud located on the top end of the adjustment block;
- a lateral cover provided with: a through hole protrusively formed in center position; a plurality of storage rooms annularly aligned surrounding the through hole; and a protruding ear at a position corresponding to an enclosed small space between the protruding ears;
- a plurality of rubbing pieces fitted in the storage rooms to provide frictional resistant force when the main body, the adjustment block, and the lateral cover start to rotate interactively;
- an adjustment stud used to penetrate the central tube and the through holes to have the main body, the adjustment block, and the lateral cover pivotally jointed to an identical axle and regulate the angle of the adjustment block; and
- a pivotally fixing stud used to penetrate the protruding ears for fixedly jointing the lateral cover to the main body.

After the stepless cymbal adjuster of this invention has been assembled on a cymbal stand in due course, the cymbal angle can be adjusted by taking advantage of the rubbing pieces embedded in the concave storage rooms of the adjustment block to meet a user's personal conditions and requirements, and when doing so, the hinged protruding ears ensure a reliable joint of the lateral cover and the main body.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
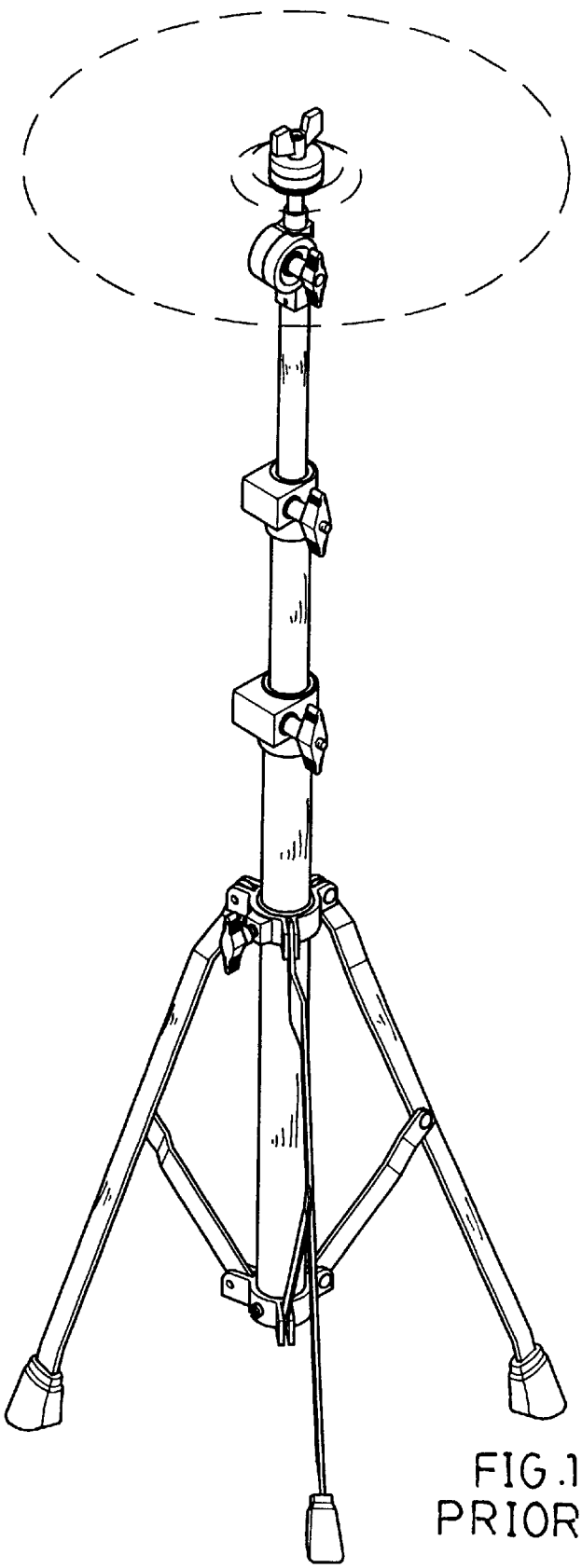
FIG.1 PRIOR ART
FIG. 1 is an elevational view of a conventional cymbal stand.
Figure 2:
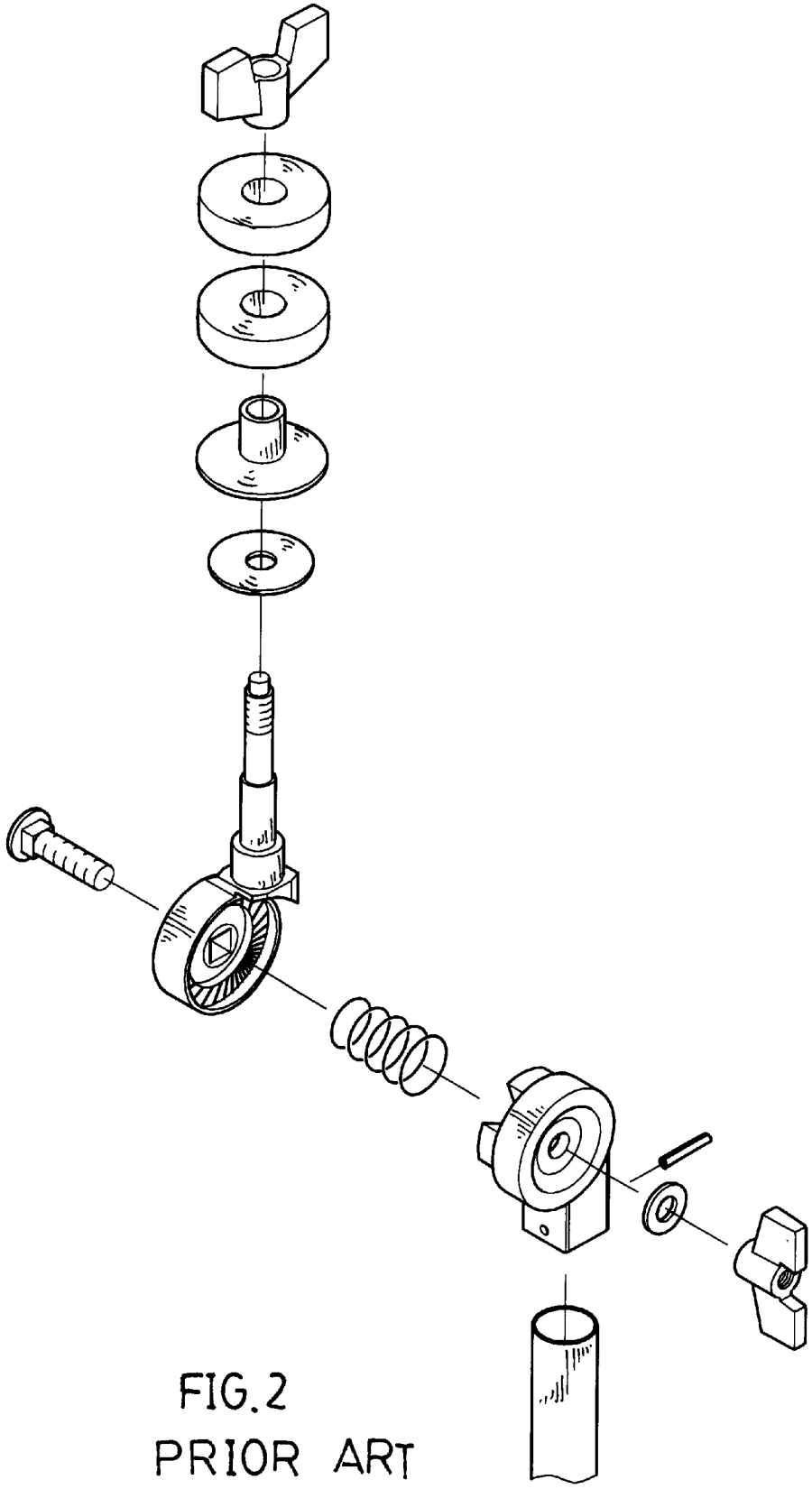
FIG. 2 PRIOR ART
FIG. 2 is an exploded view of a conventional cymbal adjuster on a cymbal stand.
Figure 3:
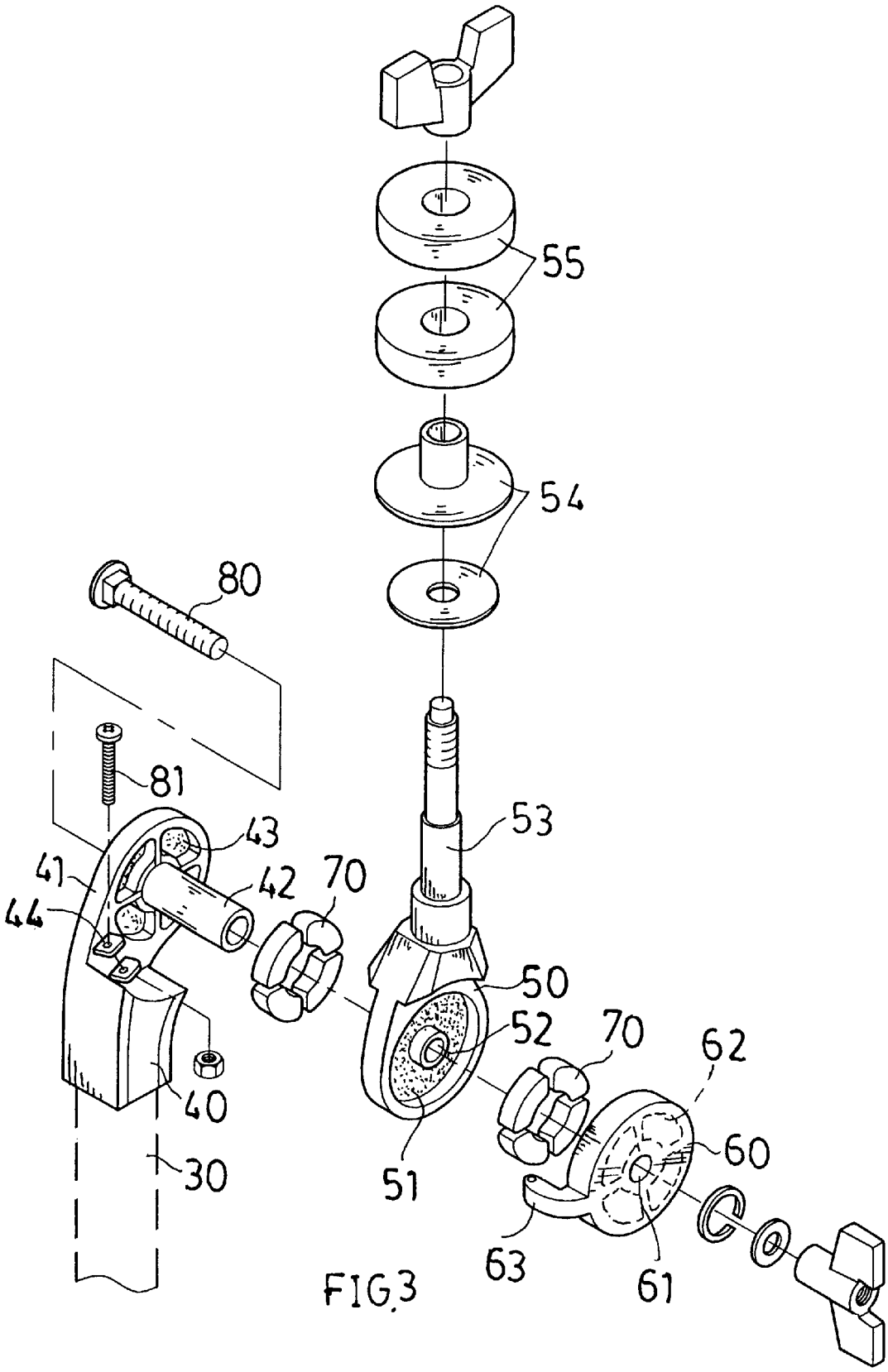
FIG. 3 is an exploded view of this invention in three dimensions.
Figure 4:
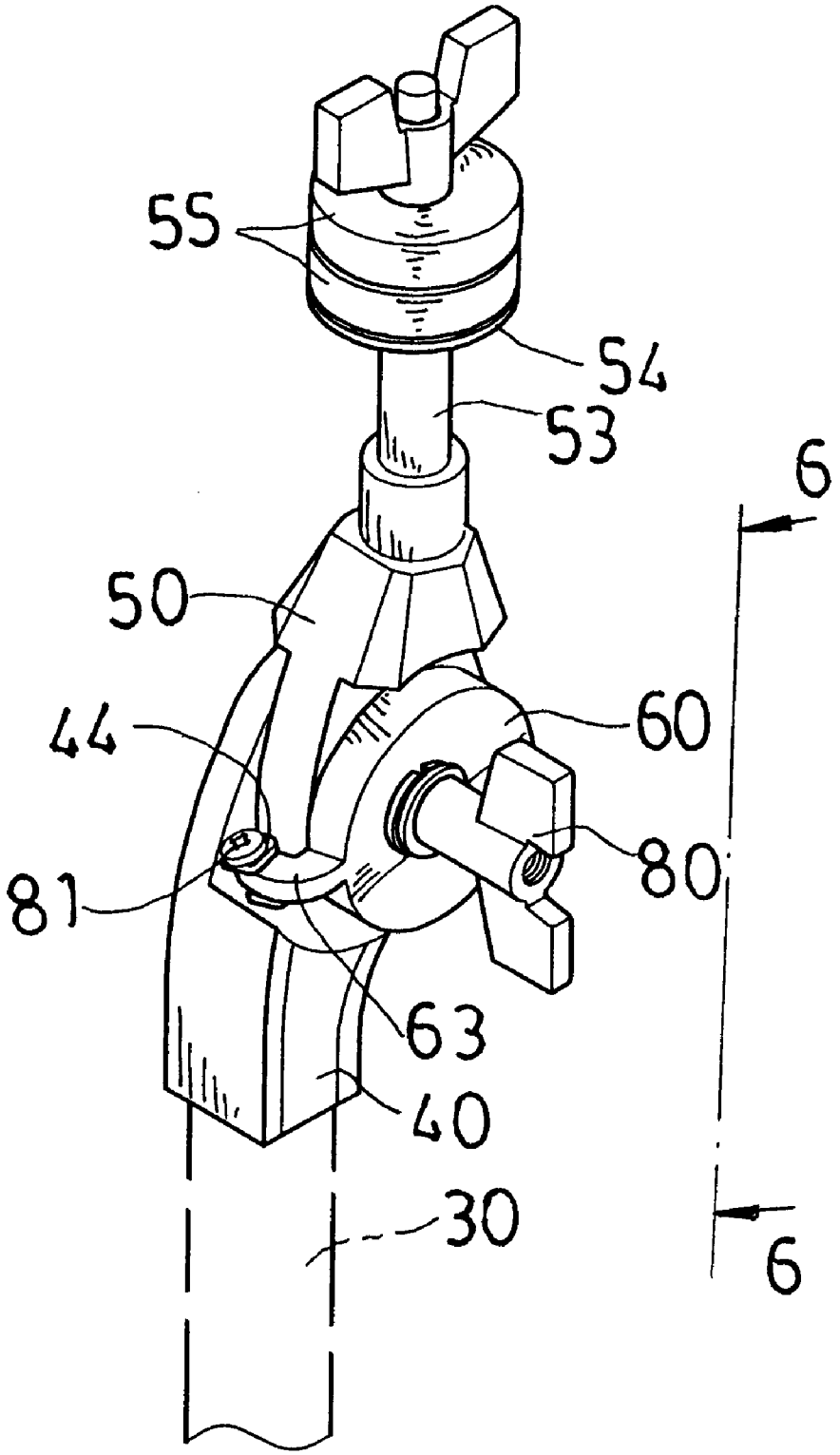
FIG. 4 is an assembled view of this invention in three dimensions.
Figure 5:
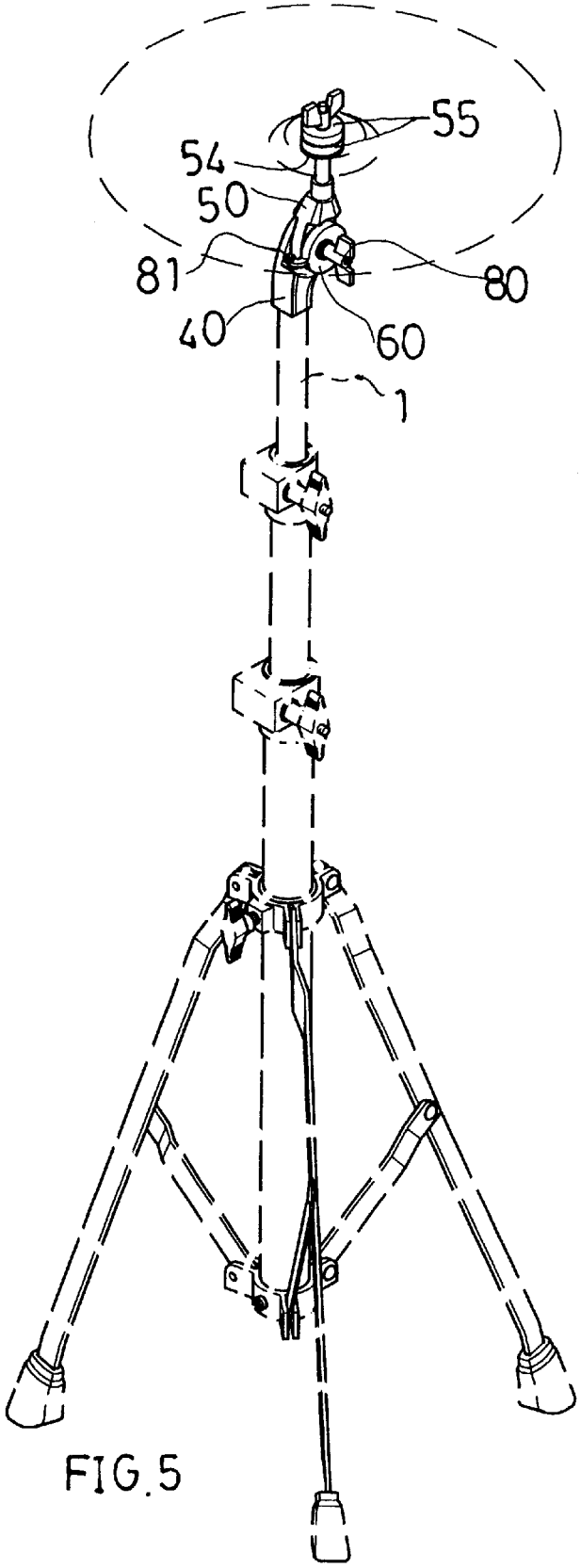
FIG. 5 is a schematic view showing an embodiment of this invention.
Figure 6:
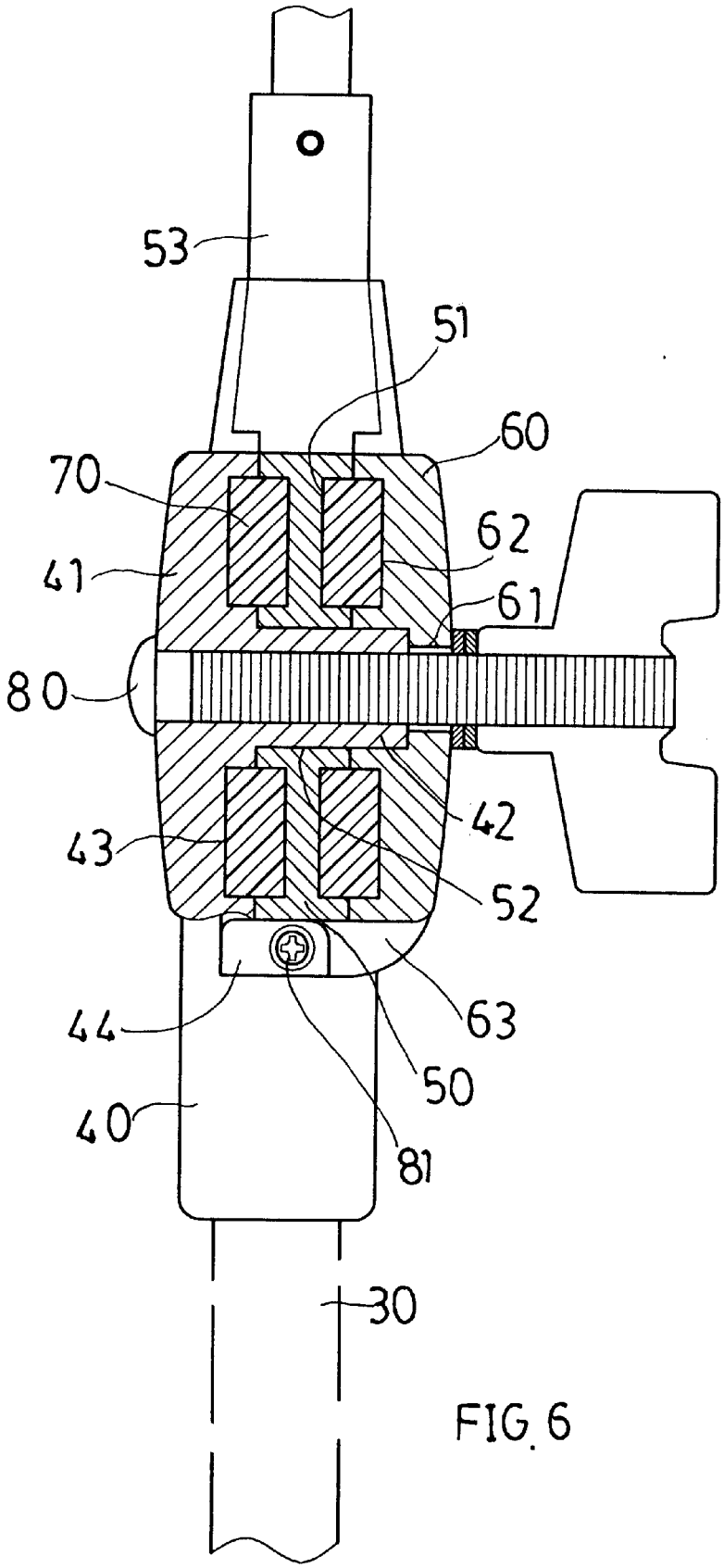
FIG. 6 is a cutaway sectional view of this invention taken along line 6—6 in FIG. 4.
Figure 7:
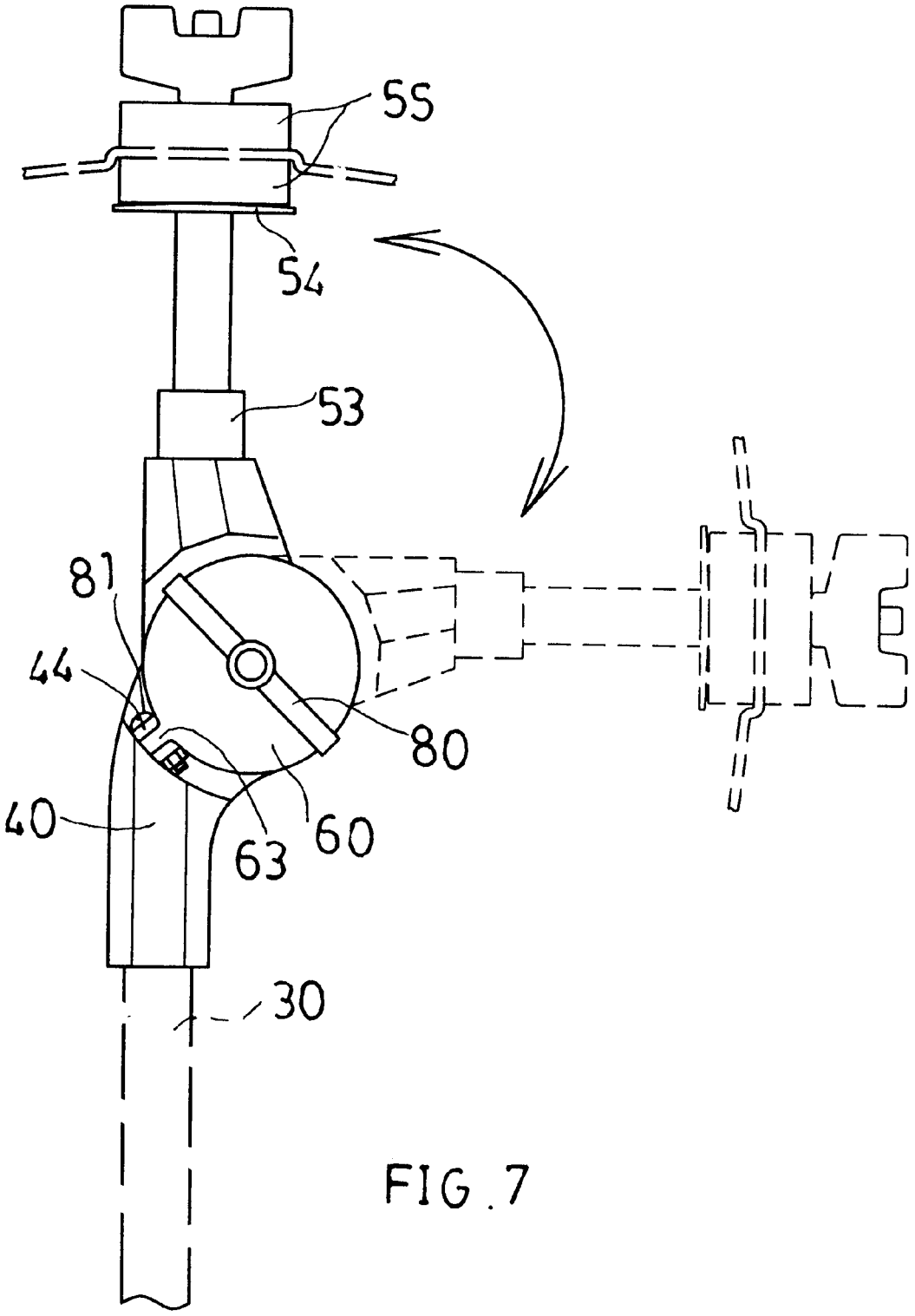
FIG. 7 is a schematic view showing an action mode of this invention.

As shown in FIGS. 3 through 7, a stepless cymbal adjuster of this invention disposed on a cymbal stand 30 at its top end mainly comprises: a main body 40, an adjustment block 50, a lateral cover 60, and a plurality of rubbing pieces 70. The main body 40 is composed of: a lateral board 41; a central tube 42 protrusively located on the lateral board 41; a plurality of concave storage rooms 43 annularly aligned surrounding the central tube 42; a coarse surface or obscured pattern formed in a lateral inner face of each storage room 43; and two pieces of protruding ear 44 adjacent to the storage rooms 43.

The adjustment block 50 is provided with: a concave storage room 51 formed in each of two lateral faces of the adjustment block 50 respectively; a centered through hole 52; an upwardly extended stud 53 located on the top end of the adjustment block 50; and, a positioning member 54 and two pieces of cotton washer 55 sequentially piled on the stud 53 for clamping a cymbal.

The lateral cover 60 contains: a through hole 61 protrusively formed in center position; a plurality of storage rooms 62 annularly aligned surrounding the through hole 61; a coarse surface or obscured pattern formed in a lateral inner face of each storage room 62; and a protruding ear 63 at a position corresponding to an enclosed small space between the protruding ears 44.

The plurality of rubbing pieces 70 is fitted in the storage rooms 43, 51, 62 invested by the main body 40, the adjustment block 50, and the lateral cover 60 to provide frictional resistant force when the main body 40, the adjustment block 50, and the lateral cover 60 start to rotate interactively.

An adjustment stud 80 is used to penetrate the central tube 42, the through hole 52, and the through hole 61 to have the main body 40, the adjustment block 50, and the lateral cover 60 pivotally jointed to an identical axle and regulate the angle of the adjustment block 50.

A pivotally fixing stud 81 is used to penetrate the protruding ears 44, 63 for fixedly jointing the lateral cover 60 to the main body 40.

After this invention has been assembled on the cymbal stand 30 in due course and when angle adjustment of a cymbal is desired, a user is supposed to swivel and loosen the adjustment stud 80, then loosen the adjustment block 50 in stepless mode to another angle by taking advantage of the coarse surface or the obscured pattern in the storage rooms 43, 62 of the main body 40 and the lateral cover 60 respectively as well as the rubbing pieces 70, then lock the adjustment stud 80 to finish the adjustment instead of engagement of a ratchet block and a ratchet ring with conventional techniques. When doing so, the hinged protruding ears 44, 63 ensure a reliable joint of the lateral cover 60 and the main body 40.

In the above described, at least one preferred embodiment has been elucidated with reference to drawings annexed, it is apparent that numerous variations or modifications may be made without departing from the true spirit and scope thereof, as set forth in the claims below.

What is claimed is:

1. A stepless cymbal adjuster, comprising:

a main body having: a lateral board; a central tube protrusively located on the lateral board; a plurality of concave storage rooms annularly aligned surrounding the central tube;

an adjustment block having: a concave storage room formed in each of two lateral faces of the adjustment block respectively; a centered through hole; and, an upwardly extended stud located on a top end of the adjustment block;

a lateral cover having: a through hole protrusively formed in center position; and a plurality of storage rooms annularly aligned surrounding the through hole;

a plurality of rubbing pieces fitted in the storage rooms to provide frictional resistant force when the main body, the adjustment block, and the lateral cover start to rotate interactively;

an adjustment stud used to penetrate the central tube, the through hole, and the through hole to have the main body, the adjustment block, and the lateral cover pivotally jointed to an identical axle and regulate the angle of the adjustment block; and a pivotally fixing stud used to penetrate two protruding ears of the main body and a protruding ear of the lateral cover for fixedly jointing the lateral cover to the main body.

2. The stepless cymbal adjuster according to claim 1, wherein a coarse surface or obscured pattern is formed in a lateral inner face of the storage rooms.

3. The stepless cymbal adjuster according to claim 1, wherein the storage rooms of the lateral board and the lateral cover are aligned annularly to accommodate the rubbing pieces to enhance frictional resistant force when the main body, the adjustment block, and the lateral cover rotate interactively.

4. The stepless cymbal adjuster according to claim 1, wherein those two protruding ears are disposed adjacently to the storage rooms; the protruding ear is located at a position corresponding to an enclosed small space between those two protruding ears; and the pivotally fixing stud is used to penetrate those two protruding ears and the protruding ear for fixedly jointing the lateral cover to the main body.

* * * * *